United States Patent [19]

Gano et al.

[11] Patent Number: 4,535,968

[45] Date of Patent: Aug. 20, 1985

[54] VALVE

[75] Inventors: John C. Gano; Gary A. Kohn, both of Carrollton, Tex.

[73] Assignee: Otis Engineering Corporation, Dallas, Tex.

[21] Appl. No.: 552,446

[22] Filed: Nov. 16, 1983

[51] Int. Cl.[3] ..... F16K 31/12

[52] U.S. Cl. ..... 251/58; 251/352; 74/107; 166/330

[58] Field of Search ..... 251/58, 252, 253, 251, 251/262, 213, 229, 283, 352; 166/332, 321, 323, 324, 329, 330; 74/57, 104, 107

[56] References Cited

U.S. PATENT DOCUMENTS

| | | | |
|---|---|---|---|
| 3,233,860 | 2/1966 | Dellison et al. | 251/58 |
| 3,398,928 | 8/1968 | Fredd | 251/251 |
| 4,103,744 | 8/1978 | Akkerman | 166/332 |
| 4,210,207 | 7/1980 | McStravick et al. | 251/251 |
| 4,262,693 | 4/1981 | Giebeler | 251/58 |
| 4,448,216 | 5/1984 | Speegle et al. | 251/58 |

FOREIGN PATENT DOCUMENTS

| | | | |
|---|---|---|---|
| 839692 | 6/1960 | United Kingdom | 251/58 |

*Primary Examiner*—Larry Jones
*Assistant Examiner*—Noah Kamen
*Attorney, Agent, or Firm*—Vinson & Elkins

[57] ABSTRACT

A ball type valve in which the ball is rotated by the cooperation of multiple tracks and multiple track followers.

Also, a pressure operated permanent lock-out is disclosed. Pressure applied to a piston withdraws an expander from under a lock ring to release a lock-out sleeve. Continued application of pressure drives the sleeve to valve lock-open position where the sleeve is permanently locked to the housing.

34 Claims, 39 Drawing Figures

VALVE

This invention relates to valves and particularly to ball type valves. While the invention is disclosed in a downhole environment, it may be utilized in any flow line, wherever located.

Petroleum wells are customarily provided at the surface with a wellhead providing for fluid flow through one or more conduits. It is customary to provide a master valve for shutting in the well when desired. For instance, the master valve might be closed to change out a flow bean.

Master valves have conventionally been provided by gate valves due to their design characteristics of great reliability and capability for multiple operations.

It would be desirable to have a master valve which could be located in the flow tubing below the surface. This is particularly true in underwater operations as a downhole master valve would eliminate many of the problems of underwater master valves.

At least one attempt has been made to design a downhole gate valve, but this design is not believed to be commercially available. See U.S. Pat. No. 4,187,876.

It has been conventional for many years to install ball type subsurface safety valves in production tubing below the wellhead, but such valves have not been able to function with the parameters provided by the American Petroleum Institute for master valves and thus have not been acceptable for use as master valves. These parameters include provision of a bubble tight seal and capability of operating for five hundred cycles.

An acceptable design of downhole ball type valve having a large, preferably substantially constant, mechanical advantage, available to rotate the ball valve has not been available. With the large substantially constant mechanical advantage available with this invention, the valve designer may choose materials and designs which will allow ball valves to be designed for applications or environments not currently possible or advisable such as use as a master valve for petroleum wells.

A subsurface valve should be designed so that if it is used under unusual conditions the valve is rugged enough that the operating linkage will not be damaged. Thus, if an attempt is made to close the valve when it is loaded up with sand or when a tool is passing through the ball valve the valve should be sufficiently rugged that full pressure can be applied to the valve operator and the linkage will not be damaged.

Subsurface safety valves conventionally are provided with provisions for locking the valve in full open position. These systems are customarily locked open utilizing mechanical means and generally are susceptible of being inadvertently locked open by tools passing through the valve. A subsurface safety valve would be more reliable if provided with a lock-open system which could not be accidentally energized by tools passing through the valve.

OBJECTS OF THE INVENTION

An object of this invention is to provide a ball valve which may be located subsurface and used as a master valve.

Another object is to provide a ball valve design having a large substantially constant mechanical advantage for rotating the ball valve member.

Another object is to provide a ball valve design having a large mechanical advantage for rotating the ball valve member which may be varied during rotation of the ball valve member.

Another object is to rotate a ball valve member by the simultaneous application of force at two spaced points located on one side of the ball valve member.

Another object is to provide an actuator for a ball valve member in which rotational force is simultaneously applied to four spaced points on the ball valve member to rotate the ball valve member.

Another object is to provide a ball valve in which the valve member is rotated by the cooperation of tracks and track followers and in which the tracks are mounted for movement in a manner to accommodate the cooperation of straight tracks with track followers which move in an arcuate path.

Another object is to provide a ball valve in which the valve member is rotated by the cooperation of tracks and track followers, each of which have multiple lands and grooves designed to ride over any trash lodged in the grooves.

Another object is to provide a lock-out system for locking the valve member of a safety valve in open position which system cannot be actuated by tools travelling through the valve.

Another object is to provide a valve as in the preceding object in which the lock-out system is actuated by pressure.

Other objects, features and advantages of the invention will be apparent from the drawings, the specification and the claims.

DESCRIPTION OF THE DRAWINGS

In the drawings wherein an illustrative embodiment of this invention is shown and wherein like reference numerals indicate like parts.

DESCRIPTION

Figure 1:
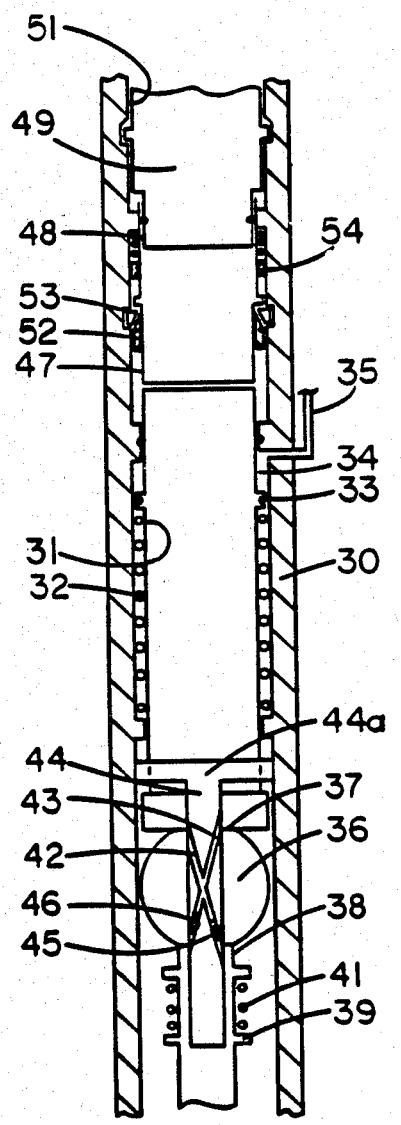
FIG. 1 is a schematic line drawing of a valve constructed in accordance with this invention.

Reference is first made to FIG. 1 for an undertanding of the principles of this invention. The FIG. 1 line drawing shows a housing 30 which may be made up in a well tubing in the conventional manner to provide a tubing retrievable subsurface safety valve which may be utilized as a master valve on a petroleum well.

Within the housing 30 there is provided an actuator 31 which is urged in an upward direction by a resilient means, such as the spring 32.

A means is provided for reciprocating the actuator. The piston 33 on the actuator provides a part of the pressure responsive chamber 34 which receives control fluid through the line 35 to reciprocate the actuator 31. Thus, an increase in pressure in the control conduit 35 moves the actuator 31 downwardly against the force of spring 32.

A ball valve member 36 is cooperable with an upper seat 37 and a lower seat 38 for controlling flow through the valve. The lower seat 38 is carried by a cage (not shown) which ties the lower seat support 39 to the upper seat 37 and the actuator 31 for translation therewith. The resilient means 41 urges the lower seat against the ball 36 thus trapping the ball 36 between the two seats for rotation about a substantially constant rotational axis. This axis, of course, translates with the seats as they reciprocate, but the rotational axis and the ball remain constant relative to each other.

Ball rotation means are provided by at least two tracks 42 and 43 carried by the track frame 44. The track frame 44 is supported in the housing by member 44*a*. The two tracks face inwardly to the ball and preferably lie within a single plane. While they are shown to be carried by the track frame, they could, of course, be carried by the ball valve member 36.

Track followers 45 and 46 run in tracks 42 and 43, respectively. In the illustration shown the tracks are indicated to be on the track frame and the followers 45 and 46 are carried by the ball 36.

Thus, as the actuator 31 reciprocates it reciprocates the upper and lower seats 37 and 38 therewith and the track followers 45 and 46 are reciprocated in the tracks 42 and 43 forcing the ball to rotate about its central axis between open and closed positions.

At the upper end of the valve a lock-out sleeve 47 is provided which may only be shifted to lock-out position by hydraulic fluid. Normally the bore through and above the lock-out sleeve 47 is open for production and to permit well tools to be run therethrough. When it is desired to utilize the lock-out sleeve a plug 48 is run into the well on a locking mandrel 49 which is landed in the landing nipple 51 to locate the plug 48 within the lock-out sleeve 47. Thereafter, by pressuring up the upper end of the tubing, pressure is exerted on piston 52 to withdraw it from under the locking ring 53 releasing the sleeve 47 which is then driven downwardly by the piston to lock the actuator 31 in valve lock-open position. When in this position the spring loaded latch 54 maintains the lock-out sleeve 47 in its down position.

Figure 2:
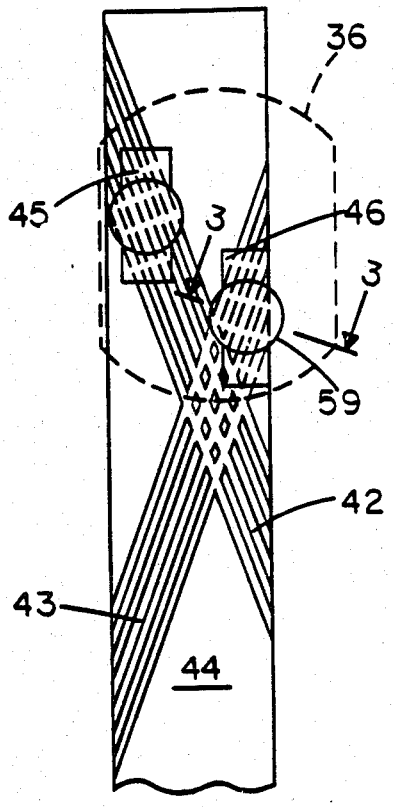
FIG. 2 is a schematic line drawing of a fragment of the track frame and cooperative trunnions on one side of the ball valve which is indicated in dashed lines.
Figure 3:
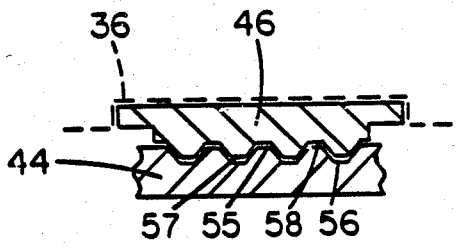
FIG. 3 is a fragmentary sectional view along the lines 3—3 of FIG. 2.

Referring to FIGS. 2 and 3, the tracks 42 and 43 are preferably made up of a plurality of lands 55 and grooves 56 and this is particularly so when the tracks cross, as illustrated in FIG. 2, so that interrupted lands will be present where the tracks cross to guide the follower of one track across the other track. In like manner, the track followers are provided with multiple lands 57 and grooves 58 which cooperate with the lands and grooves in the tracks.

The track followers have a circular bearing portion 59 which are rotatably received within holes in the sides of the ball valve member which act as bearings to permit the track followers to rotate relative to the ball valve member as the ball valve member rotates about its central axis.

Preferably, a track frame is provided on each side of the ball and the ball carries two track followers on each side to cooperate with the track frames so that as the track frames and ball move relative to each other there is a simultaneous and continuous application of force to the ball at four points resulting in a greater strength. Preferably the track angles are such that a substantially longer stroke than typical is used. This allows a large mechanical advantage which permits the invention to be used with double seats, if desired, as is the case when the valve is designed for use as a master valve.

Preferably, the tracks are straight and at equal angles to a plane normal to the inner face of the track frame and extending parallel to the direction of reciprocation of the track or ball. This results in a combined moment arm of the track followers on each side of the ball which remains constant, even though the moment arm of the individual track followers may be changing. There results a constant mechanical advantage for rotation of the ball valve member 36 between its open and closed position. In other words, it is preferred that the relationship be that of a couple in which the force applied is applied through two points a constant distance apart.

Figure 4:
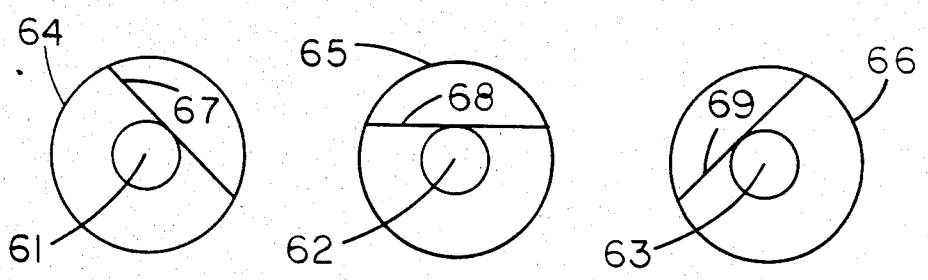
FIG. 4 and FIG. 5 illustrate a graphical solution of the design of cooperating tracks and trunnions in accordance with this invention.
Figure 5:
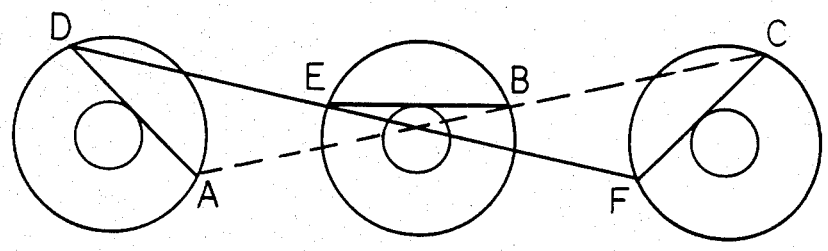

The angles of the tracks and the placement of the track followers are infinite in number. The problem may be solved graphically or mathematically. The graphic solution is illustrated in FIGS. 4 and 5. This solution forces the ball to be on center line at three places, closed, midstroke, and open. This is adequate for preliminary design and is reasonably quick. After a design is selected in this manner, a mathematical solution will give more exact information.

The graphic solution assumes that the track followers move in a straight line. A curved path presents more design and machining problems, but offers more freedom and accuracy to work with.

First draw three dots 61, 62 and 63 on a straight line which represent the center of rotation of the ball at the start, middle and end of rotation and represent the selected stroke length. Then draw three equal circles 64, 65 and 66 about each dot 61, 62 and 63, respectively, to represent the maximum radius to the operating pins. Then draw three lines 67, 68 and 69 with the lines 67 and 69 being forty-five degrees (45°) from the line 68 and ninety degrees (90°) to each other and each a chosen equal distance from the three dots 61, 62 and 63. The intersection of the line 67 and the circle 64 at point A represents the position of one of the track followers with the ball in one extreme position. In like manner, the intersection of the line 68 and the circle 65 at point B represents the position of the track follower with the ball at its rotational midpoint. The intersection of the line 69 and the circle 66 at point C represents the position of the track follower with the ball fully rotated. In like manner, the points D, E and F represent the position of the other track follower during rotation of the ball. Connecting the points A, B, C and the points D, E, F should result in approximately straight lines. If not, the solution should be repeated choosing a different distance for the lines 67, 68 and 69 from their respective center points 61, 62 and 63.

As will appear hereinafter, different solutions will result in straight or curved lines interconnecting the three points and the two track followers on each side of the ball may be required to travel through arcuate paths as desired. Also the track followers need not be the same distance from the center points 61, 62 and 63.

When a graphic solution is reached with acceptable lines indicating the angle of each track, various checks can be made. For instance, with the pin position on the ball flats as in the solution, will they interfere with other parts of the valve, such as the seat housing or other mechanism? Can the pins be made strong enough? Is there enough room for the tracks to be cut and satisfactory bearing areas with those tracks? If for any reason these basic checks are not satisfactory, a new radius can be selected and the graphic solution repeated. With the basic design selected, more exact analysis of load and bearing areas and stress can be undertaken and simple adjustments or compromises may be made to minimize induced errors in the ball motion to prevent the ball from being forced off center as it operates.

Frictional values can be assigned to all parts, both optimum values and worst case values. A math model may be built and calculated to insure that the valve satisfies the mechanical strength and safety of operation requirements. The designer has the freedom to select the more critical design criteria. He can get more strength, more mechanical advantage, minimize space or operating force as desired.

The preferred design has straight tracks. The center of rotation of the ball and the center line of the track frame have a relative motion of less than 0.2% of the stroke. In order to maintain the ball rotating about its central axis, accommodation may be made in any desired manner to permit cutting of straight tracks and yet permitting the track followers to depart from the straight line movement a slight amount. For instance, in the preferred form of the invention the track frame is permitted to follow the divergence of the track followers from straight line movement, as will appear hereinafter.

Figure 9:
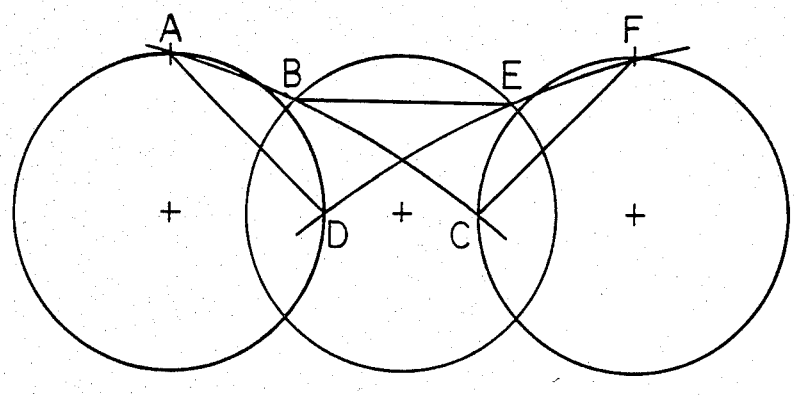
Figure 10:
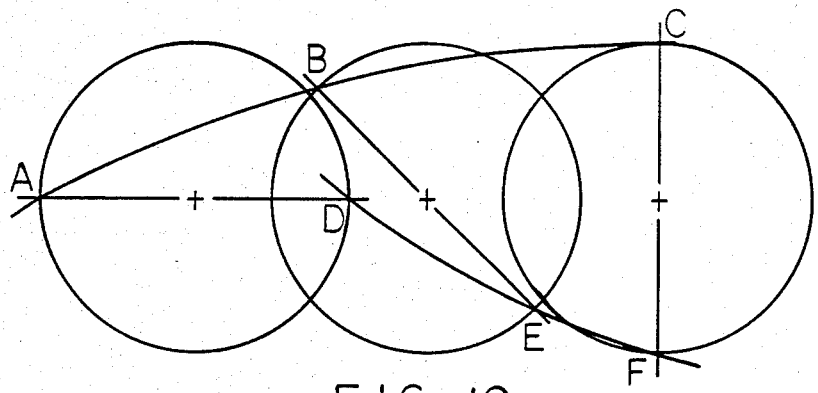
Figure 11:
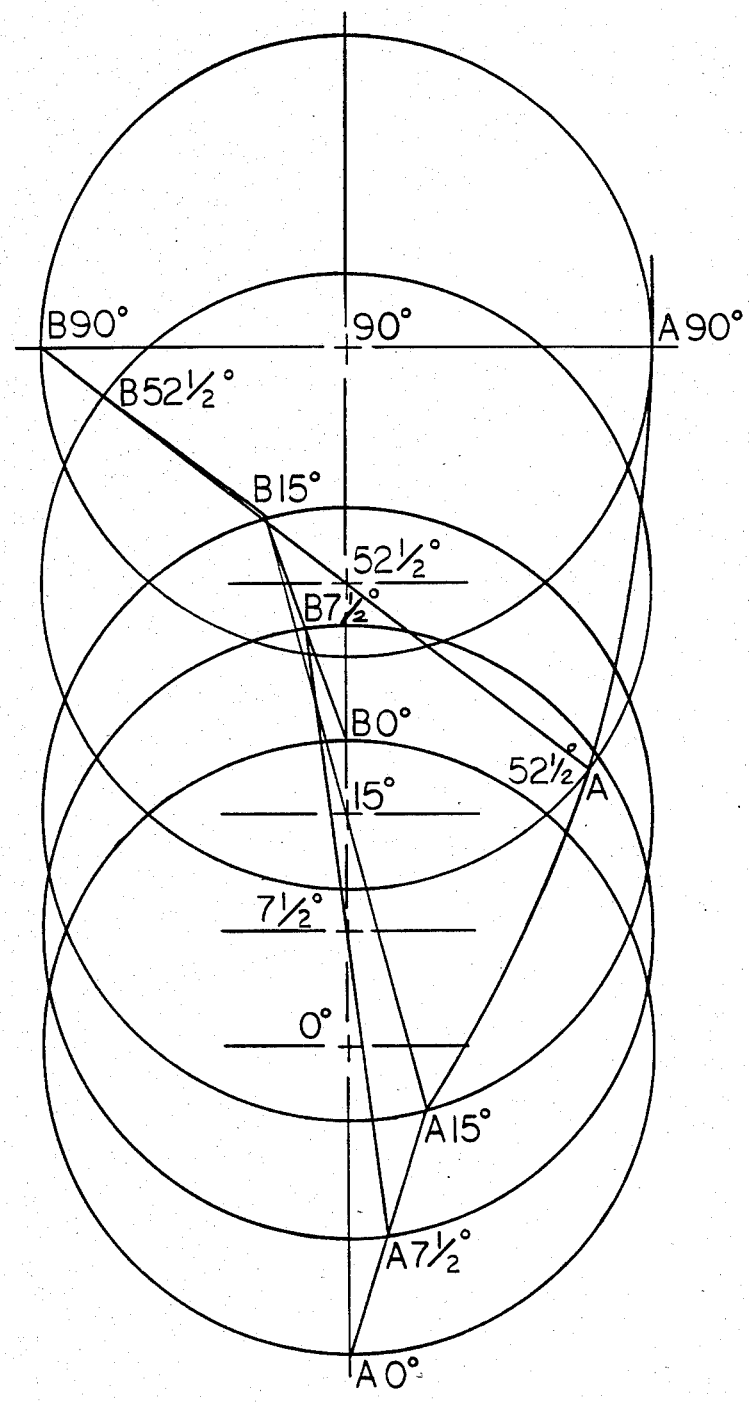

FIGS. 6 through 11 and 13 illustrate various graphic solutions with the pin travel being in approximately a constant radius. FIG. 11 is a special design case to combine different mechanical advantages. The designs which have straight paths for the pins are special cases of curved paths with a radius which approaches infinity. Each is a special subset to the general solution to the ball valve operator described. The valve operators here described are basically mechanisms designed to draw approximately straight lines with the ball center line relative to the operating track frames. This minimizes the space required for the valve operator and also helps minimize any unwanted forces on the ball and seat during rotation. As note above, if desired, the paths of the pins can be adjusted (not a constant radius or a true straight line) so that the mechanism makes as straight a line as desired or measurable. In most cases, however, this is not necessary as a little movement of the track frames perpendicular to the operating stroke of the ball valve can easily be allowed for in the design. The true straight line mechanism is useful if all side thrust is to be eliminated from the ball and the valve operator apply only torque to the ball. This requires that all reaction forces be fed directly to the valve housing and not indirectly through the ball seats to the housing.

It is possible to adjust the length of the moment arms of the track followers to balance the friction force between the ball and seat so that the ball will not see any forces trying to make it climb out of the seat. This is helpful with large inner diameter to outer diameter ratio ball valves that have narrow seats. For the valve that must cut wire or other foreign objects in order to close, the torque arms can be selected so that they force the ball and seat to have intimate contact and therefore cut more efficiently with less damage to the ball and seat.

Figure 6:
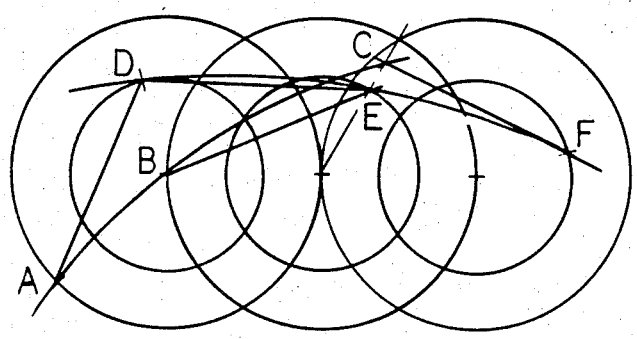
FIGS. 6 through 13 illustrate various graphical solutions of the design of ball valve tracks and trunnions in accordance with this invention.

In FIG. 6 there is shown a ball which rotates clockwise with motion left to right of the ball relative to the track frames. The system was drawn with arbitrary different track follower radius and initial location, thus requiring two different track radiuses and location of the center of the radius. Constant radius paths are depicted because in most cases this accuracy is satisfactory. An exact path can be determined mathematically, if desired.

Figure 7:
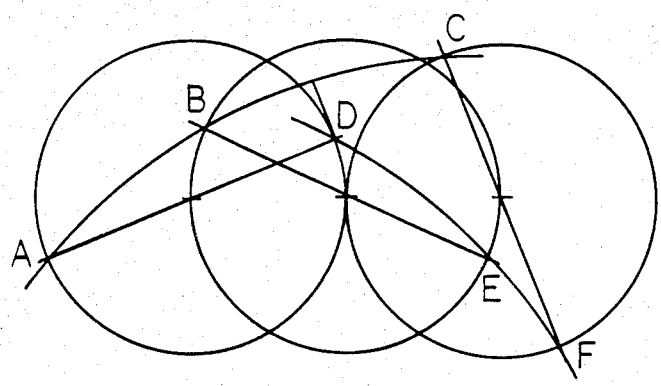

FIG. 7 illustrates a system drawn with the radius to the pins one-half of the stroke length. Note that in this system the tracks do not intersect. Because the track followers do not cross paths they can be made shorter and therefore the valve may be made smaller, the track follower stronger, or the track follower radius greater. Also, since no track intersection exists the track follower can be made to roll down the track and reduce friction losses, if desired.

Figure 8:
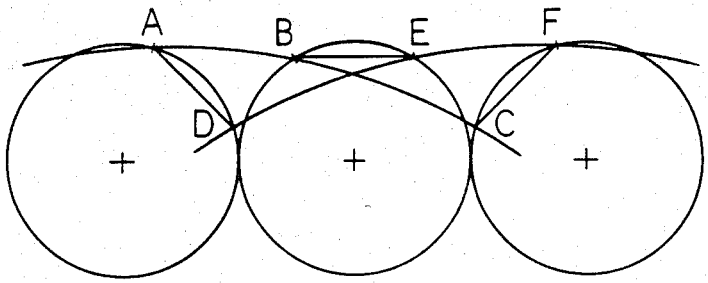

FIG. 8 illustrates a system in which the pins do not cross the center line of the valve, thus allowing more space beside the ball for other parts, such as a cage to tie upper and lower seats together.

FIGS. 9 and 10 show track follower radiuses of one-third the stroke length. These two Figures illustrate the difference in the path of travel of the track followers resulting from the selected location of the pins. FIG. 10 illustrates the pins as far apart as practical and also shows non-intersecting paths for the tracks. This Figure could be made into a very strong operator for those designs requiring large amounts of power.

FIG. 11 depicts the adjustment of the power of the valve operating system as needed for instant high mechanical advantage to open the valve until the valve equalizes and reduced mechanical advantage to shorten the stroke where desired. The solution is drawn with two speeds of rotation. During the first one-third of the stroke, zero to fifteen degrees of rotation occurs. Then fifteen to ninety degrees of rotation occur in the remaining two-thirds of stroke. One-sixth rotation is accomplished in the first one-third of the stroke. Five-sixths rotation is accomplished in the last two-thirds stroke. This solution demonstrates that any combination of mechanical advantage can be put together allowing the designer to control torque as required for the design application. The Figure illustrates the placement of the two pins A and B at zero, seven and one-half and fifteen degrees, as well as at fifty-two and one-half and ninety degrees.

Figure 12:
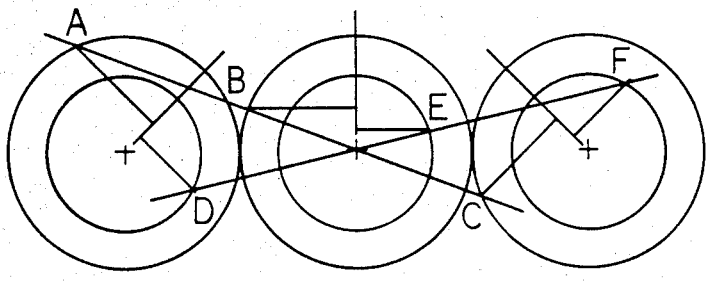

FIG. 12 depicts the general case of the straight path solutions when the radius to the pins is different and therefore the tracks are at different angles to the axes of the valve.

Figure 13:
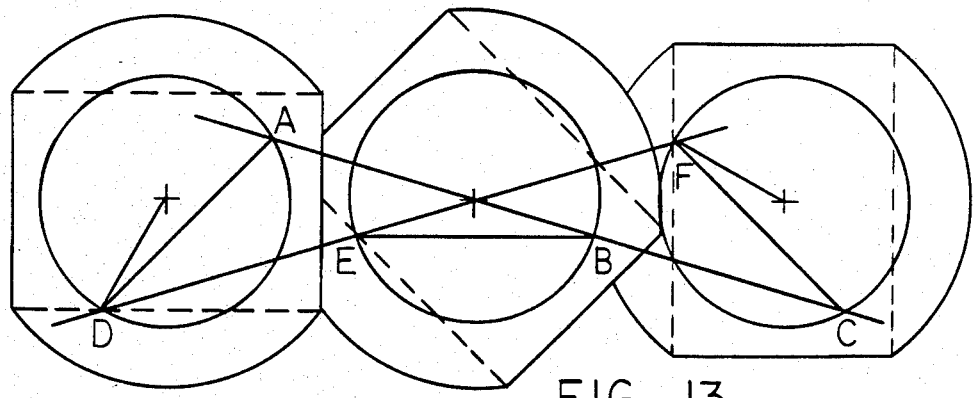

Finally, FIG. 13 illustrates a solution with the stroke five times the radius to the pins with the ball outer diameter shown in its three positions for reference. The outer diameter of the ball was omitted in the previous solutions to simplify the drawings and is included in this solution for clarification.

Figure 15:
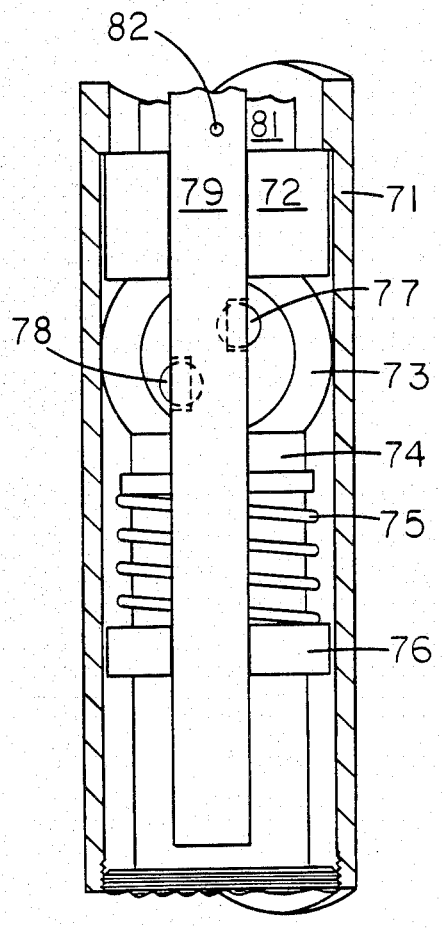
FIGS. 14 and 15 illustrate this invention incorporated in a ball valve having a non-translating ball.
Figure 14:
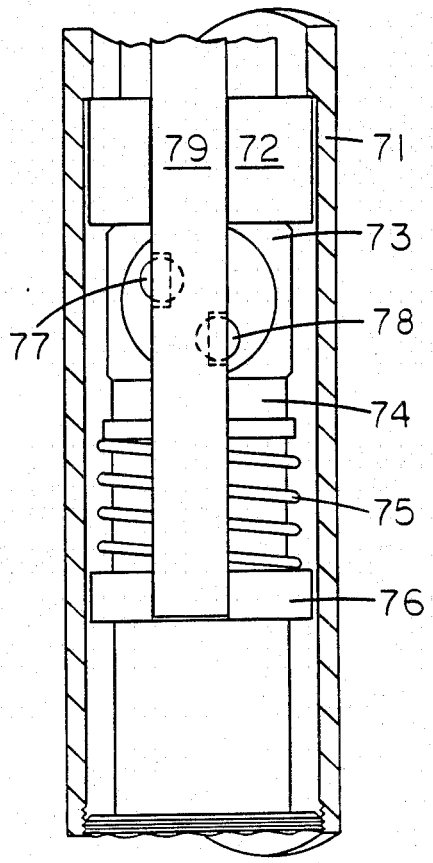
Figure 30:
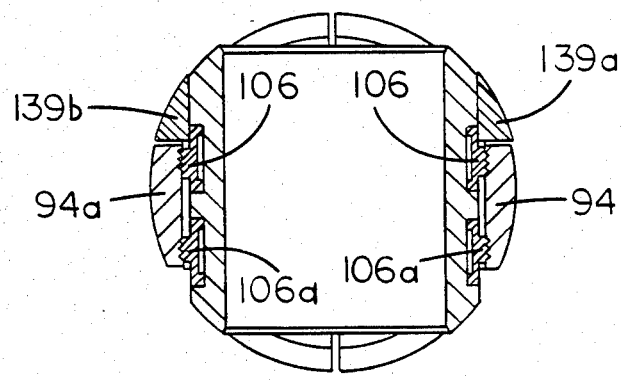
FIG. 30 is a view along the lines 30—30 of FIG. 29.

In FIGS. 14 and 15 there is shown a fragment of a ball valve in which a non-translating ball is utilized and the track frame reciprocates. The housing 71 supports an upper seat 72 against which the ball 73 is held by the lower seat 74. The lower seat 74 is urged against the ball by spring 75 supported on the lower seat support 76.

Track followers 77 and 78 are journalled in flats on opposite sides of the ball with two of the track followers shown engaging the track frame 79 on one side of the ball. A like track frame would engage like followers 77 and 78 on the opposite side of the ball.

The track frame 79 is carried by the valve actuator 81 by being pinned thereto by a pivot pin 82. As the valve actuator reciprocates it causes reciprocation of the track frame 79 causing rotation of ball valve member 73 between its open and closed positions as illustrated in FIGS. 14 and 15.

Figure 17:
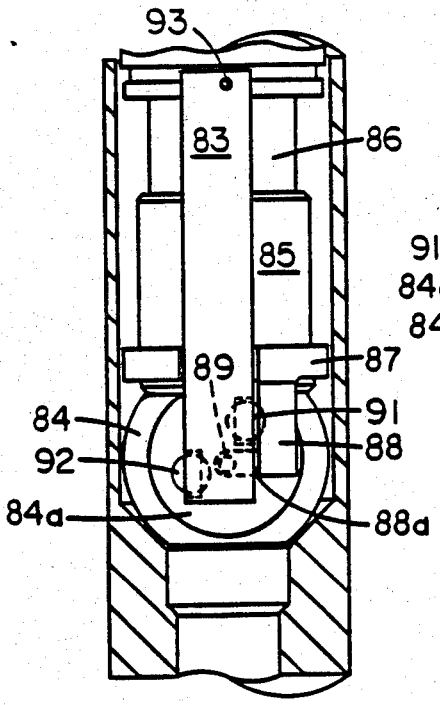
FIGS. 16 and 17 represent another form of this invention employing a translating ball.
Figure 16:
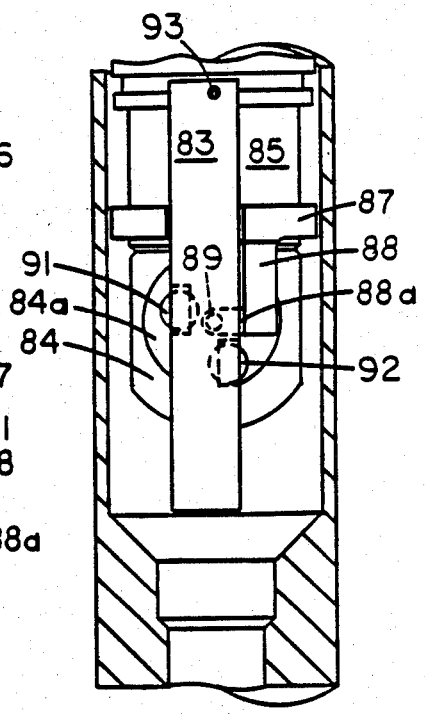
Figure 21:
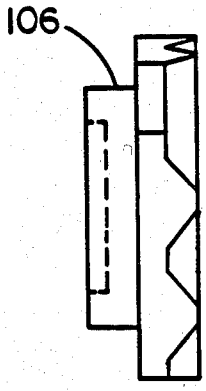
FIG. 21 is a view in elevation of one of the trunnions cooperable with the track frame.

FIGS. 16 and 17 illustrate the invention applied to a valve having non-translating track frames 83 and a translating ball 84.

The seat 85 is carried by the actuator 86.

A cage 87 is mounted on the seat 85 and includes a depending L-shaped arm 88 having its horizontal leg 88*a* extending between the track frame and the flat 84*a* on the ball valve member. As shown in dashed lines, a pivot 89 is provided between the ball valve member 84 and the leg 88*a* to position the ball valve relative to the valve seat 85.

Track followers 91 and 92 run in tracks in the track frame 83 in the manner hereinabove described.

As the seat and ball translate between the positions shown in FIGS. 16 and 17, the ball is positioned adjacent the seat during the entire travel by the pivot pin 89 and a comparable pin on the opposite side of the valve while the track frame 83 is held against longitudinal movement by being pinned to the frame by pivot 93.

It will be appreciated that with the ball supported by pivots 89, the ball rotates about the axis of the pivot 89 and in this type of design a single track frame and a single pair of track followers might be utilized, if desired. It will normally be preferred to utilize two track frames with their associated track followers to obtain the additional strength.

Figure 20:
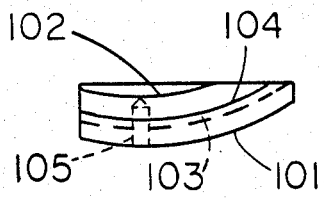
FIG. 20 is an end view of the track frame of FIG. 18.
Figure 19:
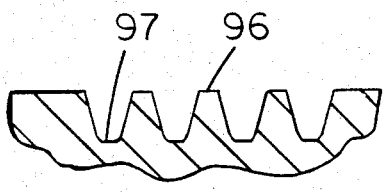
FIG. 19 is a view along the lines 19—19 of FIG. 18.
Figure 18:
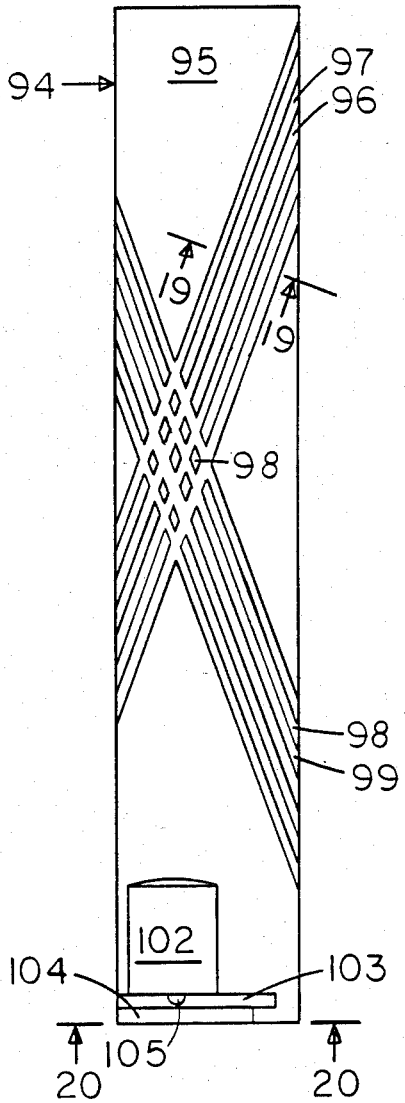
FIG. 18 is a view of the track frame from the interior of the ball valve.

FIGS. 18, 19 and 20 illustrate a form of track frame that may be used in a non-translating frame design, such as shown in FIGS. 1, 14, 15, 16 and 17 described hereinabove, and in FIGS. 26 and 27 to be hereinafter described.

The frame 94 has the generally flat side 95 in which one track is formed by the multiple lands 96 and grooves 97. The other track is formed by the multiple lands 98 and grooves 99. The particular configuration employed has crossing tracks which extend at equal angles to the center line of the frame and in the crossing section of the tracks the land segments 98 serve to guide the track followers. From FIG. 19 it is apparent that the side walls of adjacent lands diverge outwardly so that a track follower having a mating design will be able to ride over any trash which may become lodged in the grooves. The two tracks are straight but they could be curved, if desired. With the straight tracks it is expected that a small amount of transverse movement of the tracks is acceptable and this is provided for in the design.

As shown in FIG. 20, the backside of the track frame is curved as at 101 for bearing against the wall of the valve housing. On the flat side 95 of the track, as shown in FIG. 18, the frame is curved at 102 by machining out a curved portion of the flat surface 95 to permit the frame to lie against a circular support, as will be explained in conjunction with FIG. 25. At its upper end the frame has a groove 103 for interlocking with a supporting annulus surface. The groove is annular, as shown in dashed lines 103 in FIG. 20. The upper flange 104 above the groove is also annular to permit the frame to lie against a circular support with the groove 103 providing an interlock between the support and the frame. A hole 105 is provided for pinning the frame to its support. The size of the groove 103 and its supporting flange should provide sufficient clearance for the frame 94 to rock about hole 105 and move transverse to its longitudinal center line to accommodate movement of the track followers in a slightly arcuate path along the straight tracks.

Figure 22:
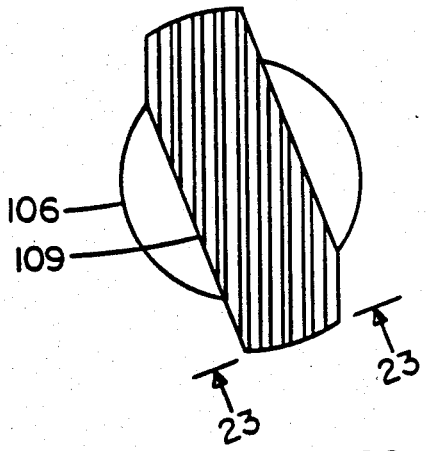
FIG. 22 is a view from the track frame side of a trunnion.
Figure 24:
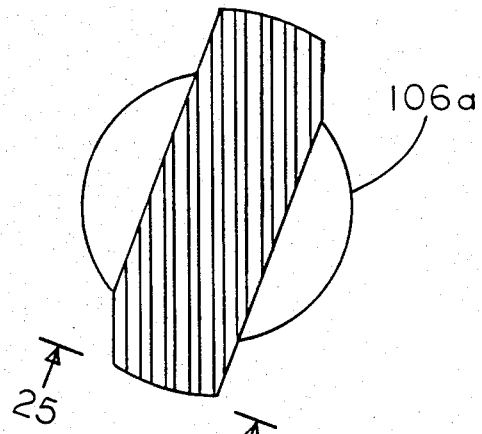
FIG. 24 is a view from the track frame side of a second trunnion.
Figure 23:
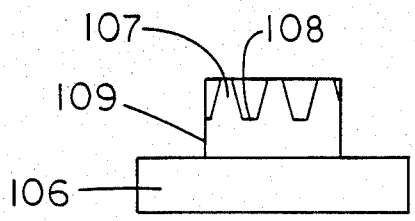
FIG. 23 is a view along the lines 23—23 of FIG. 22.
Figure 25:
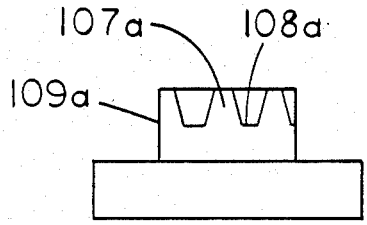
FIG. 25 is a view along the lines 25—25 of FIG. 24.
Figure 29A:
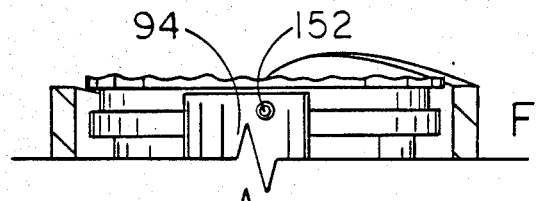
FIGS. 29A and 29B are views partially in section and partially in elevation of a segment of the valve illustrating the cage, ball and track frames.
Figure 29B:
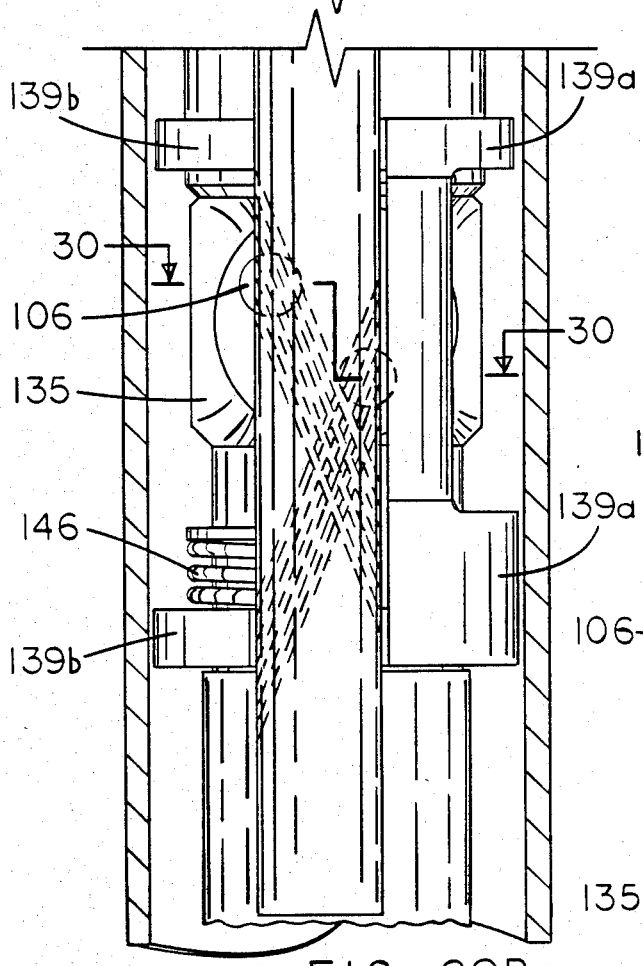
Figure 28:
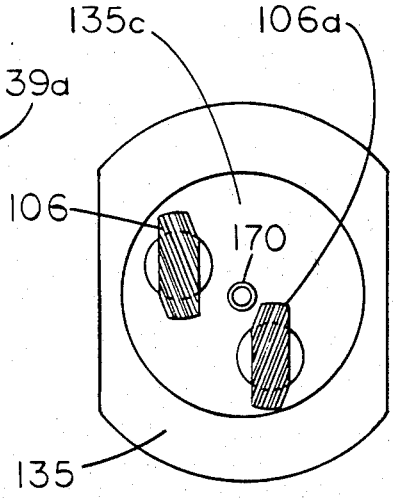
FIG. 28 is an elevational view of the ball valve with the track followers shown in place.

In FIGS. 21 through 25 track followers for cooperation with the tracks of track frame 94 are illustrated. The track follower of FIG. 21, 22 and 23 includes a trunnion or circular portion 106 to be received within a hole in the ball valve member for rotation therewith. The track follower is provided with alternate lands and grooves 107 and 108 formed in an elongate portion 109 of the track follower. These lands and grooves are formed so that adjacent flanges of lands diverge outwardly to cooperate with the mating lands and grooves of the track frame for sliding relative thereto and for forcing the track frame and track follower apart a slight distance to permit the follower to pass over debris which may become lodged in the grooves of the track frame, or vice versa. FIGS. 22 and 23 show the right hand track follower and FIGS. 24 and 25 show the left hand track follower which is identical to the right hand track follower except that the angle of the lands and grooves are different from those shown in FIG. 22. This permits the section of the track follower 109 which includes the lands and grooves to extend substantially longitudinally of the track frame 94 to conserve space. Comparable parts of the left hand track followers have the same members followed by the letter "a".

In the past the coefficient of friction between the ball and seat, and particularly with a double seat, has been a major consideration in the design of the valve because of the lack of sufficient mechanical advantage to overcome the coefficient of friction of large moving parts. With the large mechanical advantage available from this invention the coefficient of friction can become of secondary consideration and the designer can select ball and seat materials which give good strength and good seal characteristics as well as good wear characteristics. The use of the multiple lands and grooves of the preferred form of this invention is not only for tracking but it gives a larger bearing area within a limited radial space.

Figures 26A, 26B, 27A, 27B:
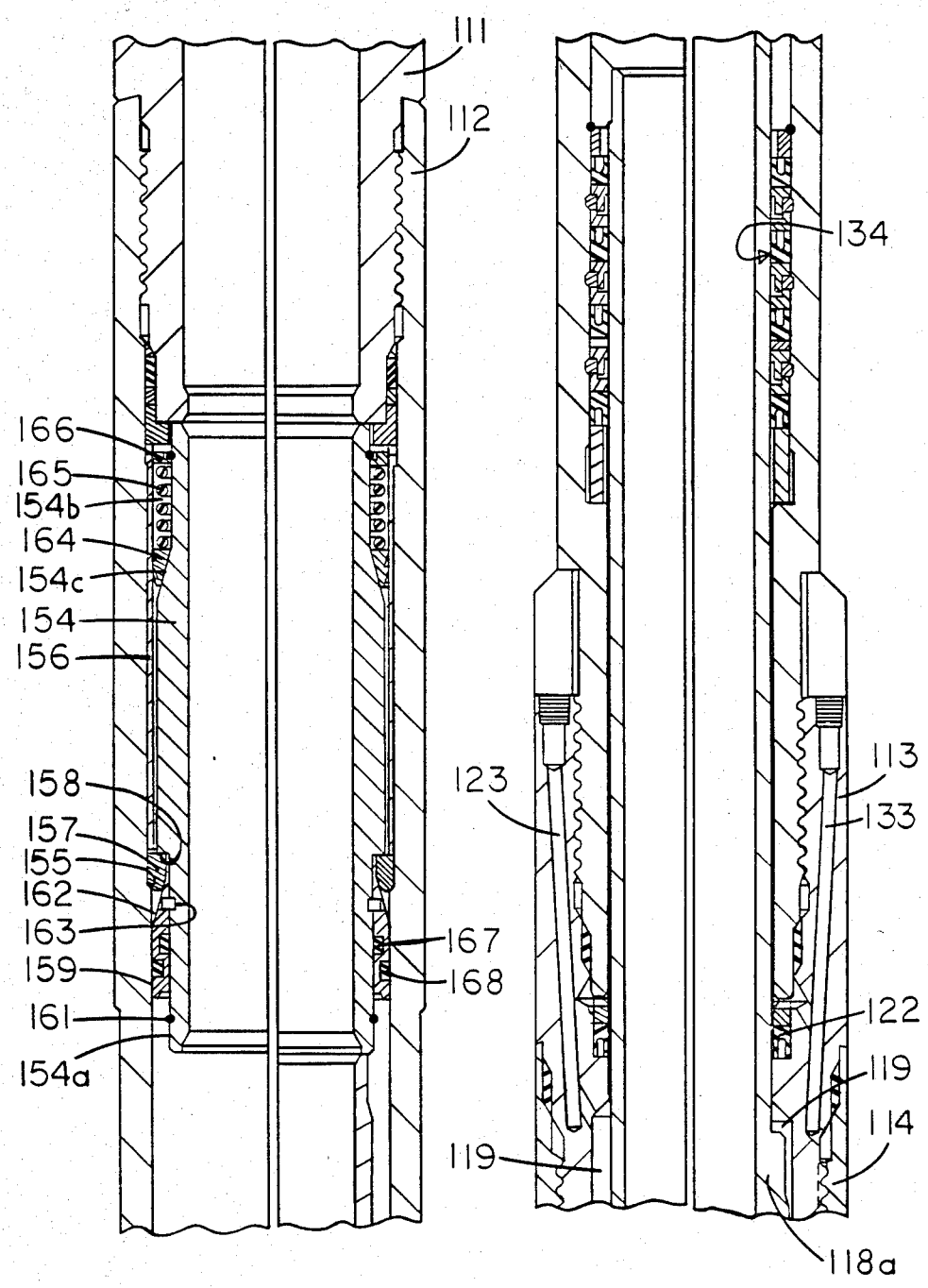
FIGS. 26A through 26E is a quarter-section view of a preferred form of valve illustrating the valve in open position.
FIGS. 27A through 27E is a view similar to FIGS. 26A through 26E illustrating the valve in closed position.
Figures 26C, 26D, 27C, 27D:
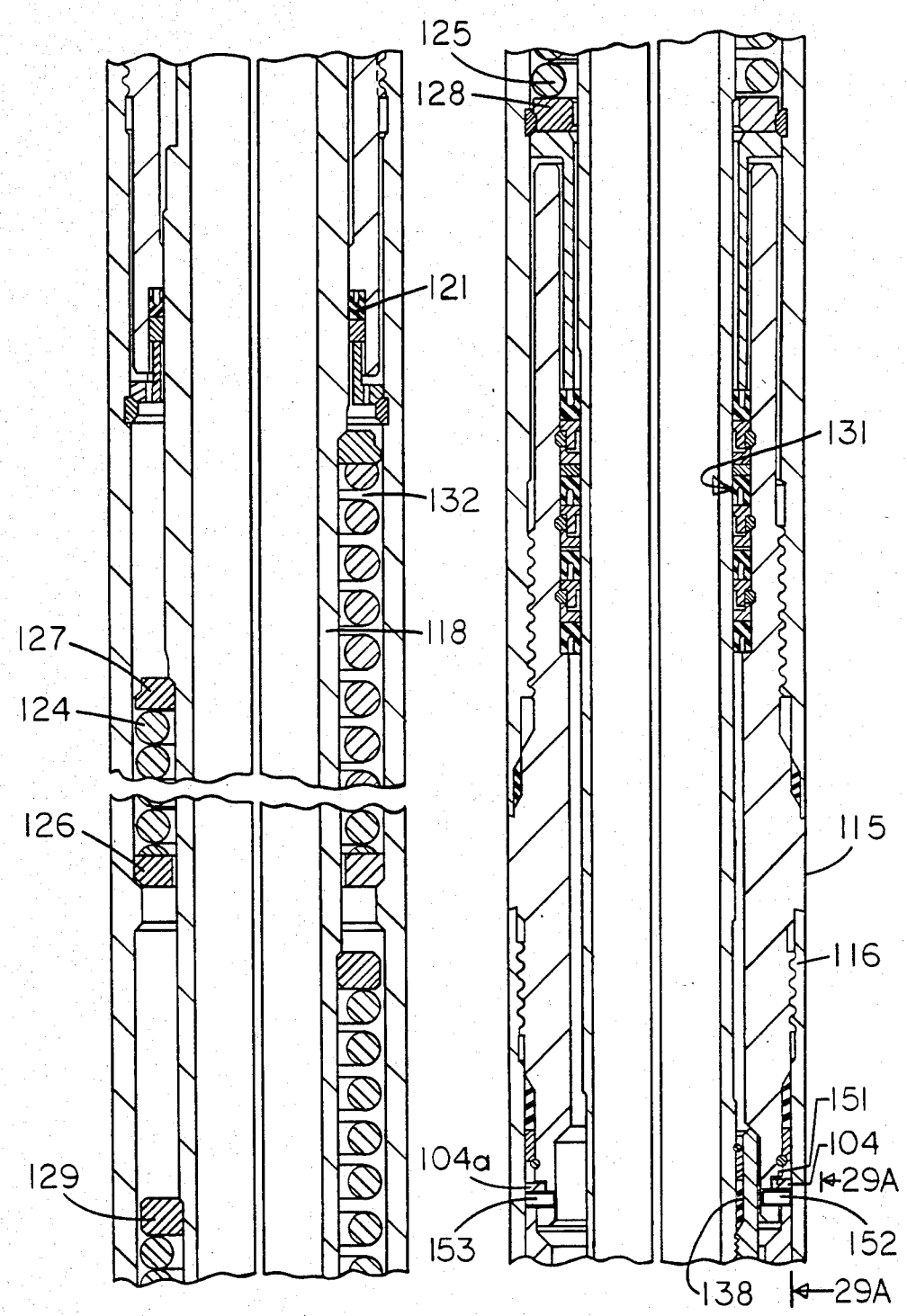
Figures 26E, 27E:
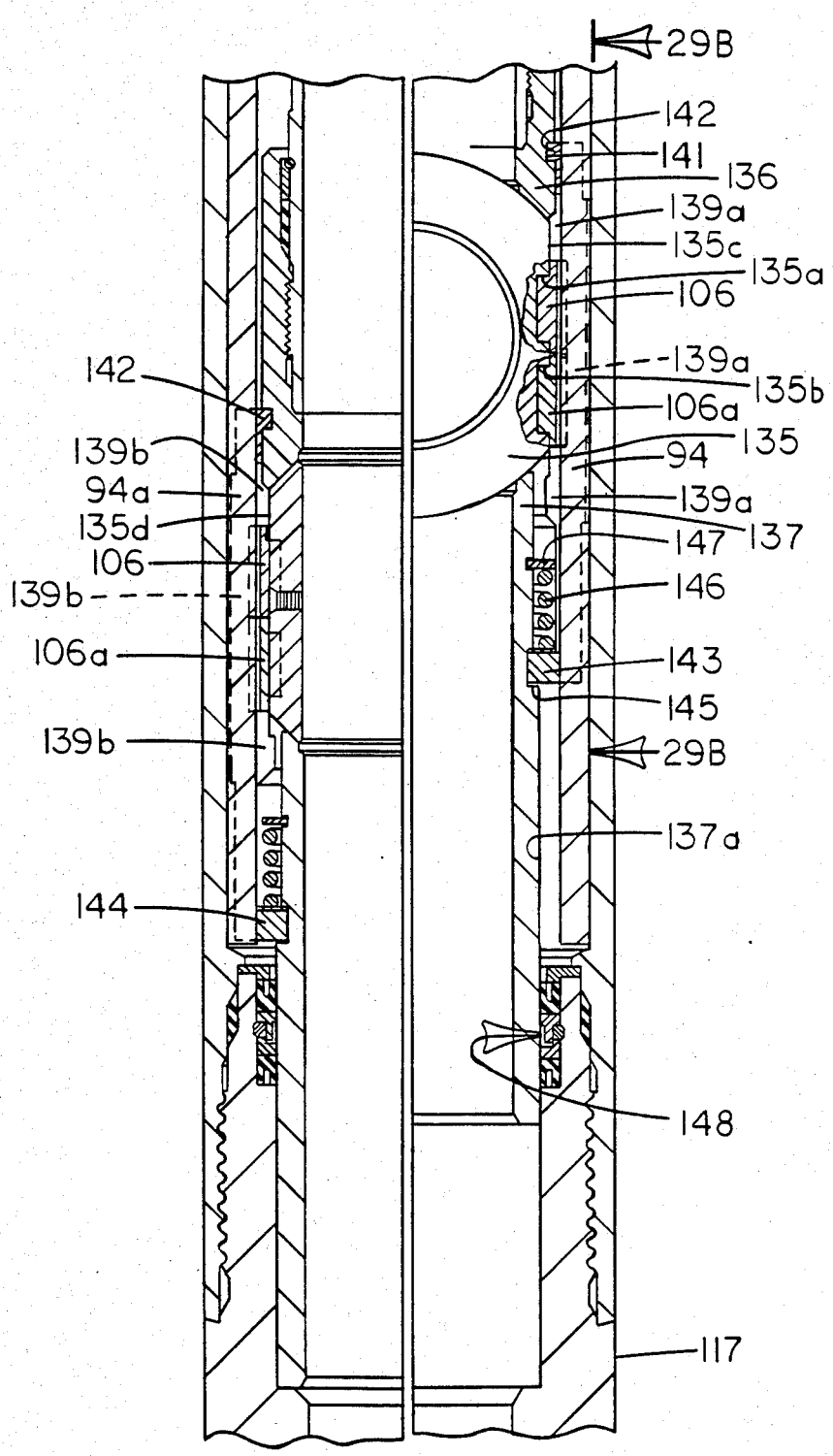

The preferred form of valve, illustrated in FIGS. 26 and 27, has a housing provided by a top sub 111, an upper housing 112, a communication sub 113, an outer mandrel 114, a connector sub 115, a lower housing 116, and a bottom sub 117.

Within the housing there is an actuator and a means for reciprocating the actuator. This actuator is provided by the single long tubular member 118 which has an enlarged piston section 118*a*.

A pressure chamber 119 is provided by a sliding seal 121 between the piston section 118*a* and the communication sub 113, together with a sliding seal 122 between the communication sub 113 and the actuator 118 at a reduced outer diameter section above the piston 118*a*.

Means for admitting control fluid into the pressure chamber 119 is provided by port 123 which will be connected to the surface through the usual small diameter conduit. When pressure is applied in the chamber 119 the actuator 118 is driven downwardly as illustrated in FIG. 26.

The means for reciprocating the actuator also includes one or more springs 124 and 125 urging the actuator 118 to an upward or closed position. The upper spring 124 is compressed between the spring support 126 on the housing and the upper spring support 127 on the actuator 118. In like manner, the lower spring 125 is compressed between the housing spring support 128 and the actuator spring support 129. These two springs are compressed by downward movement of the actuator, as will be evident by comparing FIGS. 26 and 27.

If desired, the hydrostatic head of fluid within the control line extending to the surface which is exerted within the control pressure chamber 119 may be balanced. For this purpose and to prevent flow of fluid about the exterior of the actuator 118, a seal assembly 131 is provided between the actuator 118 and the connector sub 115. This seal, together with the seal 121 between the actuator piston 118*a* and the communication sub 113, provides a balance chamber 132. Balance fluid may be introduced into the chamber 132 through the port 133 in the communication sub 113 from a line extending to the surface in the conventional manner.

Supplementing the upper seal 122 above the control chamber 119 is a seal assembly, indicated generally at 134, which both supplements the upper seal 122 and prevents flow downwardly past the actuator 118.

A ball valve member and seat are provided for controlling flow through the housing. The ball valve member is provided by ball 135 which cooperates with the upper seat 136 and the lower seat 137 to control flow through the housing.

The upper seat 136 is carried by the actuator 118 and a suitable seal 138 seals between the upper seat and actuator.

A two-piece split cage 139*a* and 139*b* is carried by the valve seat 136. For this purpose the valve seat has an external annular groove 141 in which an inturned flange 142 on the cage cooperates to suspend the cage between the lower housing 116 and the seat 136. At its lower end the cage is provided with inturned flanges 143 and 144 which extend into external groove 145 on the lower seat member 137.

The lower seat is urged toward the ball valve 135 by a compression spring 146 held between the inturned flanges 143 and 144 of the cage and a split ring 147 carried by the exterior of the lower seat 137. The axial dimension of the groove is sufficiently greater than the flanges to permit the spring 146 to hold the seat 137 against ball 135.

Preferably, well pressure also urges the lower seat toward the ball valve 135. For this purpose the lower seat has an outer diameter section 137*a* which is of larger diameter than the outer diameter section of the seat in contact with the ball 135. A seal, indicated generally at 148, seals between the lower valve seat 137 and the lower sub 117. Thus, the lower seat 137 has an area exposed to pressure therebelow which is larger than the pressure responsive area of the lower seat looking upwardly so that well pressure will urge the lower seat 137 toward its associated ball valve member 135.

Because of the large mechanical advantage available with this invention, the coefficient of friction of the ball valve member 135 and the upper and lower seats 136 and 137 is not as critical as in conventional designs and the material of these parts may be selected primarily for other characteristics, such as strength, wear and seal, to increase the utility of the valve. The industry has been seeking a subsurface safety valve which will meet the API criteria for master valves and it is expected that with the greater freedom of design provided by this invention, subsurface safety valves may now be designed utilizing materials for the ball and seat having strength, wear and seal characteristics which will permit them to be used for master valves.

It will be appreciated that in this form of valve the lower seat 137 functions to maintain the ball valve member in contact with both the upper and lower seats so that the ball valve will rotate about substantially a single rotational axis, albeit that the rotational axis travels longitudinally of the housing with reciprocation of the actuator 118.

In accordance with this invention the novel ball rotation means described above is provided. Two cooperable track are provided on opposite sides of the ball valve member and carried by one of the ball valve member and the ball rotation means with the followers carried by the other of the ball valve member and the ball rotation means. Further, one of the ball valve member and ball rotation means is carried by and reciprocal with said actuator relative to the other of said ball valve member and ball rotation means to effect simultaneous and continuous relative movement between the track and track followers and rotate the ball valve member about a substantially single rotational axis. In the form of valve illustrated two track frames 94 and 94*a* are provided on opposite sides of the valve. The internal flange 104 and 104*a* of the two track frames extend into the external groove 151 provided in the lower end of the connector sub 115. Pins 152 and 153 pin the two track frames 94 and 94*a* in position. Sufficient clearance is provided between the inturned flange 104 and 104*a* and the groove 151 and the pin 152 and hole 105 to permit the track frames to move transverse to the direction of reciprocation of the actuator 118 to thus permit the track followers 106 and 106*a* to follow a curved path while running in straight tracks. The swinging movement of the track frames about the pins is limited by the clearance between the frames and housing and the length of the frames.

On the other hand the vertical forces on the track frames are primarily applied to the interlocking flange and groove 104, 104*a* and 151. Thus, the transverse force on the track frames are primarily transmitted through the pins 152 and 153 to the housing, while the longitudinal forces are primarily transmitted to the housing through the interlocking flanges.

On each side of the ball valve member 135 there is provided the track followers 106 and 106*a* which are rotatably mounted in holes 135*a* and 135*b* in the ball valve on opposite sides thereof. It will be appreciated that the followers could be carried by the track frames and the tracks could be carried by the balls, but the length of the track would be limited and, therefore, it is preferred that the followers be carried by the ball and the tracks be carried on the track frames which can have their length selected to provide the desired mechanical advantage.

Preferably, the opposite sides of the ball 135 are provided with the flats 135*c* and 135*d* in which the holes 135*a* and 135*b* are positioned.

Within the upper housing 112 there is provided a lock-out system for locking the valve in open position which is hydraulically operated so that tools passing through the valve cannot operate the lock-out. The sleeve 154 is locked in the position shown, but is movable downwardly under pressure to engage the actuator 118 and move it to valve lock-open position.

Within the upper housing 112 a groove is provided by the upwardly facing shoulder 155 in the housing and the downwardly facing shoulder provided by the sleeve 156. Latch means is provided by a C-ring 157 positioned in said groove and bearing against the shoulder 158 on the exterior of the sleeve 154 to prevent downward movement of the sleeve. Upward movement of the sleeve is prevented by its upper end engaging and abutting against the top sub 111.

A piston 159 is provided in the annulus between the upper housing 112 and a reduced diameter section 154*a* of sleeve 154. Stop means is provided by a ring 161 on the exterior of the reduced diameter section of sleeve 158 to limit downward movement of the piston 159 relative to the sleeve.

To maintain the C-ring 157 in its groove the piston has an expander ring surface 162 which underlies the C-ring 157 when the tool is originally dressed. A shear pin 163 pins the piston 159 to the sleeve 154.

At the upper end the sleeve 154 has an upper reduced diameter section 154*b* having an upwardly and inwardly inclined shoulder 154*c* to act as an expander. Within the annulus provided by the sleeve 156 and the reduced diameter section 154*b* of the lock-out sleeve there is provided slip means 164 which is urged against the expander shoulder 154*c* by the compression spring 165 held in compression by the retainer ring 166.

When it is desired to lock the valve in open position, a plug is run into the valve and sealingly engages the inner wall of sleeve 158. The plug would be hung in the well from the conventional landing nipple by a mandrel, as indicated in FIG. 1. Thereafter, increase in pressure in the tubing above the valve would be effective upon the inner and outer seals 167 and 168 carried by the piston 159. Downward force exerted by pressure would shear the shear pin 163 driving the piston from under the C-ring 157 releasing it and permitting it to contract and release the sleeve from the housing 112. Thereafter, the pressure in the tubing above the sleeve 154 would be exerted on the sleeve and on the piston which is limited in its downward movement by the stop 161 to drive the sleeve and valve actuator 118 downwardly to the valve lock-open position.

As the sleeve moves downwardly the slip 164 would slide along the sleeve 156. After the tubing pressure is released the slip teeth on the exterior face of the slip 164 would engage the sleeve 156 and be held in locking engagement by the spring 165 to lock the sleeve 154 in full down position locking the valve in full open position.

The hole 170 in the ball valve is utilized during manufacture of the ball and may be plugged if desired.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A valve comprising, a housing, an actuator in the housing, means for reciprocating the actuator, a ball valve member and seat controlling flow through said housing, means maintaining said ball valve member and seat together, ball rotation means, at least two cooperable track followers and tracks with the tracks lying in substantially a single plane and carried by one of the ball valve member and ball rotation means and the followers carried by the other of the ball valve member and ball rotation means, one of said ball valve member and ball rotation means carried by and reciprocal with said actuator relative to the other of said ball valve member and ball rotation means and effecting simultaneous and continuous relative movement between said track and track followers and rotation of said ball valve member about substantially a single rotational axis between o,pen and closed positions.

2. The valve of claim 1 wherein two tracks and two track followers are provided on each of opposite sides of said ball valve member.

3. The valve of claim 1 or 2 wherein valve seats are provided on the upstream and downstream side of the ball valve member.

4. The valve of claim 1 or 2 wherein said ball rotation means is mounted for limited movement in a direction transverse to the rotational axis of said ball valve member.

5. The valve of claim 1 or 2 wherein said ball rotation means is pinned to one of said housing and actuator for limited swinging movement about said pin determined by the clearance between said ball rotation means and housing and the length of the ball rotation means.

6. The valve of claim 1 or 2 wherein each track is substantially straight and extends at an equal angle to a plane normal to said single plane.

7. The valve of claim 1 or 2 wherein the tracks have diverging side walls and the track followers have complementary side walls.

8. The valve of claim 1 or 2 wherein the tracks have multiple alternate lands and grooves and wherein the side walls of the grooves diverge and the track followers are rotatably mounted and have lands and grooves complementary to the lands and grooves of the tracks.

9. The valve of claim 1 wherein two tracks and two track followers are provided on one side of the ball and means are provided on the opposite side of the ball providing a central axis of rotation for said ball.

10. A valve comprising, a housing, an actuator in the housing, means for reciprocating the actuator, a ball valve member and seat controlling flow through said housing, means maintaining said ball valve member and seat together, at least two track followers carried by the ball valve member, said track followers spaced from the center of rotation of the ball valve member and travelling in two different paths with rotation of the ball valve member, ball rotation means including at least two tracks lying in substantially a single plane and engaging said track followers, one of said ball rotation means and ball valve member reciprocal relative to the other in response to reciprocation of said actuator effecting simultaneous and continuous relative movement of said tracks and followers to rotate said ball valve member between open and closed positions.

11. The valve of claim 10 wherein two tracks and two track followers are provided on each of opposite sides of said ball valve member.

12. The valve of claim 10 or 11 wherein valve seats are provided on the upstream and downstream side of the ball valve member.

13. The valve of claim 10 or 11 wherein said ball rotation means is mounted for limited movement in a direction transverse to the rotational axis of said ball valve member.

14. The valve of claim 10 or 11 wherein said ball rotation means is pinned to one of said housing and actuator for limited swinging movement about said pin determined by the clearance between said ball rotation means and housing and the length of the ball rotation means.

15. The valve of claim 10 or 11 wherein each track is substantially straight and extends at an equal angle to a plane normal to said single plane.

16. The valve of claim 10 or 11 wherein the tracks have diverging side walls and the track followers have complementary side walls.

17. The valve of claim 10 or 11 wherein the tracks have multiple alternate lands and grooves and wherein the side walls of the grooves diverge and the track followers are rotatably mounted and have lands and grooves complementary to the lands and grooves of the tracks.

18. The valve of claim 10 wherein two tracks and two track followers are provided on one side of the ball and means are provided on the opposite side of the ball providing a central axis of rotation for said ball.

19. A valve comprising, a housing, an actuator in the housing, means for reciprocating the actuator, a ball valve member and seat controlling flow through said housing, means maintaining said ball valve member and seat together, two pairs of track followers with one pair carried on each of opposite sides of the ball valve member, each of said pair of track followers spaced from the center of rotation of the ball valve member and travelling in two different paths with rotation of the ball valve member, ball rotation means including two pairs of tracks engaging said track followers, one of said ball rotation means and ball valve member reciprocal relative to the other in response to reciprocation of said actuator effecting simultaneous and continuous relative movement of said tracks and followers to rotate said ball valve member between open and closed positions.

20. The valve of claim 1, 10 or 19 wherein the means maintaining the ball valve member and seat together is a cage carried by the seat including means positioning said ball valve member for rotation about a single axis and wherein said ball rotation means is pivoted to one of said housing and said actuator and is free to swing for a limited distance about said pivot.

21. The subsurface safety valve of claim 20 wherein the means for providing for rotation of the ball valve member about a single axis is a second seat carried by the cage on the upstream side of the ball and resilient means urges the upstream seat against the ball and holds the ball against said first mentioned seat.

22. The valve of claim 20 wherein said means providing for rotation of said ball about a single axis is provided by pivot pins carried by said cage on opposite sides of said ball which limit rotation of the ball valve member to rotation about the central axis of said cage pivot pins.

23. The valve of claim 19 wherein valve seats are provided on the upstream and downstream side of the ball valve member.

24. The valve of claim 19 wherein said ball rotation means is mounted for limited movement in a direction transverse to the rotational axis of said ball valve member.

25. The valve of claim 19 wherein said ball rotation means is pinned to one of said housing and actuator for limited swinging movement about said pin determined by the clearance between said ball rotation means and housing and the length of the ball rotation means.

26. The valve of claim 19 wherein each track is substantially straight and extends at an equal angle to a plane normal to said single plane.

27. The valve of claim 19 wherein the tracks have diverging side walls and the track followers have complementary side walls.

28. The valve of claim 19 wherein the tracks have multiple alternate lands and grooves and wherein the side walls of the grooves diverge and the track followers are rotatably mounted and have lands and grooves complementary to the lands and grooves of the tracks.

29. A valve comprising, a housing, an actuator in the housing, means for reciprocating the actuator, a ball valve member and seat controlling flow through said housing, means maintaining said ball valve member and seat together, ball rotation means, at least two cooperable track followers and tracks with the tracks crossing each other and carried by one of the ball valve member and ball rotation means and the followers carried by the other of the ball valve member and ball rotation means, one of said ball valve member and ball rotation means carried by and reciprocal with said actuator relative to the other of said ball valve member and ball rotation means and effecting simultaneous and continuous relative movement between said track and track followers and rotation of said ball valve member about substantially a single rotational axis between open and closed positions.

30. The valve of claim 1, 10 or 19 including, a lock-out sleeve movable downwardly in the housing and engaging said actuator and moving it to valve open position, an internal groove in said housing, a latch means in said groove, a downwardly facing shoulder on said sleeve engaging said latch means, a piston slidably and sealingly engaging said housing and sleeve, stop means limiting relative movement between said piston and sleeve, an expander ring on said piston maintaining said latch means in said groove, shear means releasably securing said piston to one of said housing and sleeve, and a resiliently loaded slip means locking said sleeve in valve member lock-open position.

31. The valve of claim 1, 10 or 19 including, a lock-out sleeve movable downwardly in the housing and engaging said actuator and moving it to valve open position, a latch means between said sleeve and housing, pressure responsive means releasably maintaining said latch means in extended position latching said sleeve to said housing and slidable in said housing and downwardly on said sleeve to a latch release position where it is held in sealing position in the sleeve and seals between the housing and sleeve, shear means releasably holding said pressure responsive means in latch extended position, and means locking said sleeve means in valve lock-open position after release of said latch means and movement of said actuator to valve member open position.

32. A subsurface safety valve comprising, a housing, a cooperable valve member and seat controlling flow through the housing, a valve actuator reciprocal in the housing for moving the valve member between open and closed position, a lock-out sleeve movable downwardly in the housing and engaging said actuator and moving it to valve open position, an internal groove in said housing, a latch means in said groove, a downwardly facing shoulder on said sleeve engaging said latch means, a piston slidably and sealably engaging said housing and sleeve, stop means limiting relative movement between said piston and sleeve, an expander ring on said piston releasably maintaining said latch means in said groove, shear means releasably securing said piston to one of said housing and sleeve, and a resiliently loaded slip means locking said sleeve in valve member lock-open position.

33. The valve of claim 32 wherein said groove has a chamferred lower surface, and said latch means is a C-ring with a chamferred lower surface engaging the chamferred surface of the groove.

34. A subsurface safety valve comprising, a housing, a cooperable valve member and seat controlling flow through the housing, a valve actuator reciprocal in the housing for moving the valve member between open and closed position, a lock-out sleeve movable downwardly in the housing and engaging said actuator and moving it to valve open position, a latch means between said sleeve and housing, pressure responsive means releasably maintaining said latch means in extended position latching said sleeve to said housing and slidable in said housing and downwardly on said sleeve to a latch release position where it is held in sealing position on the sleeve and seals between the housing and sleeve, shear means releasably holding said pressure responsive means in latch extending positions, and means locking said sleeve means in valve lock-open position after release of said latch means and movement of said actuator to valve member open position.

* * * * *